US012607092B2

(12) United States Patent
Tonti et al.

(10) Patent No.: US 12,607,092 B2
(45) Date of Patent: Apr. 21, 2026

(54) SLIM HOLE FLOAT SUB

(71) Applicant: INNOVEX DOWNHOLE SOLUTIONS, INC., Humble, TX (US)

(72) Inventors: Nick Tonti, Humble, TX (US); Sawyer Bright, Humble, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 0 days.

(21) Appl. No.: 18/777,917

(22) Filed: Jul. 19, 2024

(65) Prior Publication Data

US 2025/0052122 A1 Feb. 13, 2025

Related U.S. Application Data

(60) Provisional application No. 63/519,038, filed on Aug. 11, 2023.

(51) Int. Cl.
*E21B 34/06* (2006.01)

(52) U.S. Cl.
CPC ..... *E21B 34/063* (2013.01)

(58) Field of Classification Search
CPC ..... E21B 34/063
See application file for complete search history.

(56) References Cited

U.S. PATENT DOCUMENTS

| | | | | |
|---|---|---|---|---|
| 1,960,337 | A * | 5/1934 | Gilstrap | E21B 31/20 166/55.8 |
| 3,721,506 | A * | 3/1973 | Anderson | F01D 5/3038 411/63 |
| 5,150,756 | A * | 9/1992 | Hassanzadeh | E21B 33/14 166/242.6 |
| 5,479,986 | A * | 1/1996 | Gano | E21B 33/12 166/292 |
| 7,806,189 | B2 | 10/2010 | Frazier | |
| 9,593,542 | B2 | 3/2017 | Getzlaf et al. | |
| 10,465,445 | B2 | 11/2019 | Getzlaf et al. | |
| 10,683,728 | B2 | 6/2020 | Kellner et al. | |
| 2014/0216756 | A1 | 8/2014 | Getzlaf et al. | |
| 2017/0138153 | A1 | 5/2017 | Getzlaf et al. | |

* cited by examiner

*Primary Examiner* — D. Andrews
(74) *Attorney, Agent, or Firm* — MH2 Technology Law Group, LLP

(57) ABSTRACT

A downhole tool includes a housing having an inner surface. And inner groove is formed in the inner surface. The downhole tool also includes a body positioned in the housing. The downhole tool also includes a plurality of retention members positioned at least partially within the inner groove. The retention members initially prevent the body from moving in a downhole direction relative to the housing. The retention members are configured to yield, which allows the body to move in the downhole direction relative to the housing.

16 Claims, 10 Drawing Sheets

SLIM HOLE FLOAT SUB

CROSS-REFERENCE TO RELATED APPLICATIONS

This application claims priority to U.S. Provisional Patent Application No. 63/519,038, filed on Aug. 11, 2023, which is incorporated by reference.

BACKGROUND

After a wellbore is drilled, a casing string is lowered into the wellbore. While running the casing string in the wellbore, buoyancy in the well fluid to support a portion of the weight of the casing string by floating the casing string in the well fluid. Typically, plugs (or packers) are installed inside the casing string to isolate a portion of the casing string. The isolated portion of the casing string may be filed with a low-density fluid or air to create a buoyant force when the casing string is lowered into the wellbore. The plugs (or packers) are eventually removed from the casing string by a costly drilling operation. Therefore, there is a need for a casing float sub that may be selectively removed from the casing string without the need of a drilling operation.

SUMMARY

A downhole tool is disclosed. The downhole tool includes a housing, a body positioned in the housing, and a plurality of shearable balls disposed between the body and the housing. The sharable balls are configured to yield to release the body to move relative to the housing.

In another embodiment, the downhole tool includes a housing defining a shoulder. The downhole tool also includes a frangible obstruction positioned in the housing. The downhole tool also includes a plurality of retention members disposed within the housing, between the frangible obstruction and the housing. The retention members are configured to retain an axial position of the body relative to the housing. The retention members are configured to yield to release the frangible obstruction to move relative to the housing. The frangible obstruction is configured to impact the shoulder of the housing and break.

In another embodiment, the downhole tool includes a housing having an inner surface. An inner groove is formed in the inner surface. The downhole tool also includes a body positioned in the housing. The downhole tool also includes a plurality of retention members positioned at least partially within the inner groove. The retention members initially prevent the body from moving in a downhole direction relative to the housing. The retention members are configured to yield, which allows the body to move in the downhole direction relative to the housing.

A casing float sub for use in a well is also disclosed. The casing float sub includes a housing having an inner surface. A groove and a shoulder are formed in the inner surface. The groove includes a slot that has a greater width than a remainder of the groove. The casing float sub also includes a body positioned in the housing. The body defines a beveled nose that is configured to fit at least partially through the shoulder. The casing float sub also includes a plurality of tabs positioned at least partially within the groove. The tabs are configured to be introduced radially-outward through the slot and into the groove. The tabs are configured to slide circumferentially within the groove after being introduced via the slot such that the tabs become circumferentially offset from one another within the groove. The tabs are prevented from being removed from the groove when the tabs are misaligned with the slot. Each tab has an outer portion and an inner portion. The outer portions form dovetail connections within the groove. The inner portions are configured to contact the body. The inner portions initially prevent the body from moving in a downhole direction relative to the housing. The inner portions are configured to yield in response to a predetermined force exerted therein by the body, which allows the body to move in the downhole direction relative to the housing. The body is configured to impact the shoulder and break apart after the inner portions yield.

A method is also disclosed. The method includes positioning a body in a housing. The method also includes installing a plurality of retention members radially between the body and the housing. The method also includes deploying the body, the housing, and the retention members into a well. The method also includes increasing a pressure of a fluid in the well at least until reaching a breaking pressure. The fluid reaching the breaking pressure causes at least some of the plurality of retention members to fail. The at least some of the plurality of retention members failing causes the body to move in the housing.

In another embodiment, the method includes positioning a body in a housing. The housing has an inner surface, and wherein a groove is formed in the inner surface. The method also includes positioning a plurality of retention members at least partially within the groove. The retention members initially prevent the body from moving in a downhole direction relative to the housing. The method also includes deploying the body, the housing, and the retention members into a well. The method also includes increasing a pressure of a fluid in the well, which causes the retention members to yield. The body moves relative to the housing in response to the increased pressure and the retention members yielding.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
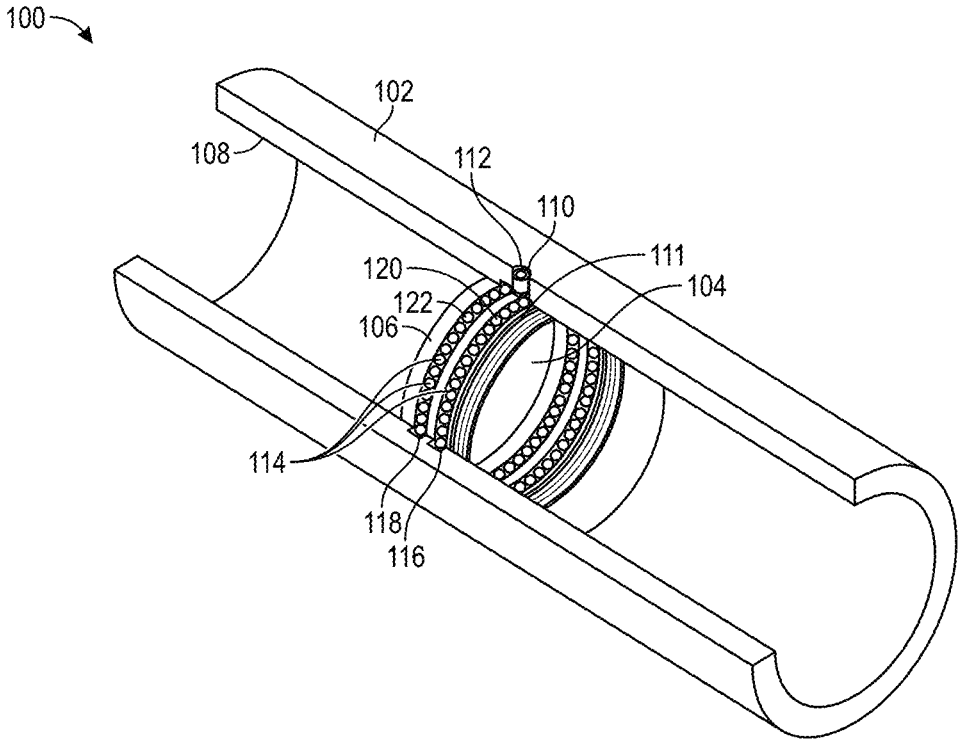
FIG. 1 illustrates a perspective, partially sectional view of a downhole tool with retention members (balls) therein, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective, partially-sectional view of a downhole tool 100, according to an embodiment. The downhole tool 100 may be a float sub, for example. In other embodiments, the downhole tool 100 may be another type of tool used in another application. The tool 100 generally includes an outer housing 102, which may be integrally formed from a single piece of pipe. That is, the outer housing 102 in the illustrated embodiment is a monolithic tubular, not two or more tubulars that are connected (e.g., threaded) together. In other embodiments, the outer housing 102 may be made of two or more tubulars that are connected together. In the view of FIG. 1, the outer housing 102 is shown with one quarter section removed to permit the interior of the outer housing 102 to be viewed.

Within the outer housing 102, the downhole tool 100 may include a body (e.g., a frangible obstruction) 104. In other embodiments, the body may be any other structure that can be received into the outer housing 102 (e.g., a plug, sleeve, etc.). The frangible obstruction 104 may be made of a ceramic or another suitable material, and may generally be shaped as a disk, as shown. The axially-facing surfaces of the disk may be flat, concave, or convex. Further, the frangible obstruction 104 may include an outer diameter surface 106, which may slide along, e.g., or otherwise be sized to fit within an inner diameter surface 108 of the outer housing 102. A seal 111 may be positioned around the outer diameter surface 106.

The outer housing 102 may include one or more ports 110 (only one is visible in FIG. 1), which may extend radially therethrough, as shown, permitting access to the inside of the outer housing 102 between the axial ends of the outer housing 102. The port(s) 110 may be plugged in with a plug 112 when such access is not desired. The plug 112 may be threaded into the port 110 and sealed therewith. The port 110 may be sized and configured to receive retention members 114 therethrough. In the illustrated embodiment, the retention members 114 are spherical, shearable balls, but could be cylindrical members or any other suitable geometry.

The retention members 114 may be configured to reside between the outer diameter surface 106 and the inner diameter surface 108. That is, unlike shear pins, set screws, etc., the retention members 114 are not partially within both components; rather, the retention members 114 are disposed within the outer housing 102 and radially between the outer housing 102 and the frangible obstruction 104. A curved surface of the retention members 114 engages and is able to roll against the inner and outer diameter surfaces 108, 106, potentially permitting the frangible obstruction 104 to rotate, which may facilitate installation of the retention members 114 via the port 110.

For example, a first groove 116 may be formed in the inner diameter surface 108, and a corresponding first groove 118 may be formed in the outer diameter surface 106. The grooves 116, 118 may be continuous and without end, or may be segmented. When the first grooves 116, 118 are aligned, the retention members 114 may be received into both, and may prevent axial displacement of the frangible obstruction 104 relative to the outer housing 102 once positioned in the grooves 116, 118. The radii of the retention members 114 may be approximately equal to the radius of curvature of the grooves 116, 118. In the illustrated embodiment, a second groove 120 in the outer diameter surface 106 is also provided, as well as a corresponding second groove 122 in the inner diameter surface 108. Some of the retention members 114 may be received between into the second grooves 120, 122 via a port (not visible) in the outer housing 102 instead of in the first grooves 116, 118. The two rows of retention members 114 may cooperate to distribute loads incident on the frangible obstruction 104, e.g., pressure differentials across the frangible obstruction 104.

At least some of the retention members 114 may be formed from a relatively hard material, such as a ceramic, metal, composite, etc. The retention members 114 may be configured to yield under a predetermined force, which may release the frangible obstruction 104 to move relative to the outer housing 102, as will be described in greater detail below. At least some of the retention members 114 may optionally be made from a sacrificial material that is relatively soft and yields at a lower force than the retention members 114 made of the harder material(s). For example, the softer retention members 114 may be made from a plastic. Thus, the softer retention members 114 may maintain a spacing of the retention members 114 relative to one another and/or a spacing/orientation of the frangible obstruction 104 relative to the outer housing 102, without substantially increasing the pressure at which the retention members 114 yield.

Thus, the force that results in the yielding of the retention members 114 and releasing of the frangible obstruction 104 may be configured by selecting a certain number of hard retention members 114 and a certain number of soft retention members 114. In some embodiments, additional tuning of the yielding force may be recognized by providing the relatively hard retention members 114 from two or materials with different hardness values. That is, one or more of the relatively hard retention members 114 may be made from a harder material that another one of the relatively hard retention members 114. Accordingly, a certain number of the different relatively hard retention members 114 may be selected to configure the tool 100.

Figure 2:
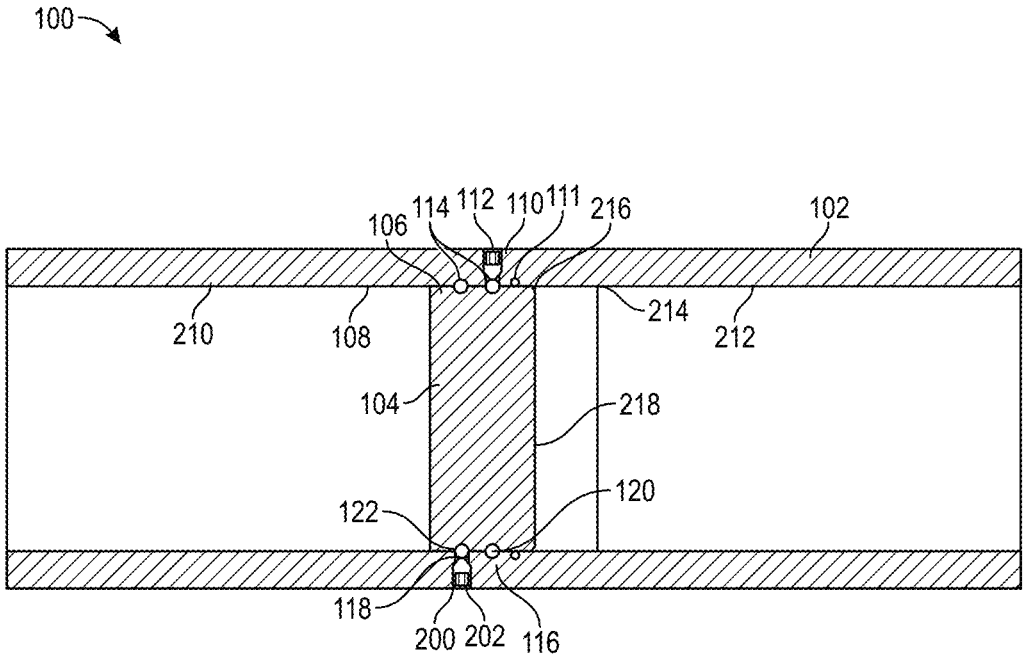
FIG. 2 illustrates a side, cross-sectional view of the downhole tool in a first configuration, according to an embodiment.

FIG. 2 illustrates a side, cross-sectional view of the downhole tool 100 in a first configuration, according to an embodiment. The first configuration may be representative of the initial configuration of the downhole tool 100 after assembly, e.g., as it is run into a well. The frangible obstruction 104 is located within the outer housing 102, and held in position by the retention members 114 received into the first grooves 116, 118 via the port 110, as well as retention members 114 received into the second grooves 120, 122 via a port 200, which may be filled thereafter with a plug 202.

The inner diameter surface 108 of the outer housing 102 may not have a constant diameter. For example, the diameter of the inner diameter surface 108 may change slightly to accommodate connections on either axial end of the outer housing 102, e.g., for threading subjacent and superposed tubulars thereto in a pipe string. In particular, in the illustrated embodiment, the inner diameter surface 108 defines a first section 210 and a second section 212. The inner diameter surface 108 in the first section 210 having a larger diameter than the inner diameter surface 108 in the second section 212. A shoulder 214 may be formed between the first and second sections 210, 212. As also visible in FIG. 2, the frangible obstruction 104 may have a beveled nose 216 extending to its downhole facing surface 218. The beveled nose 216 may be sized to fit at least partially through the shoulder 214.

Figure 3A:
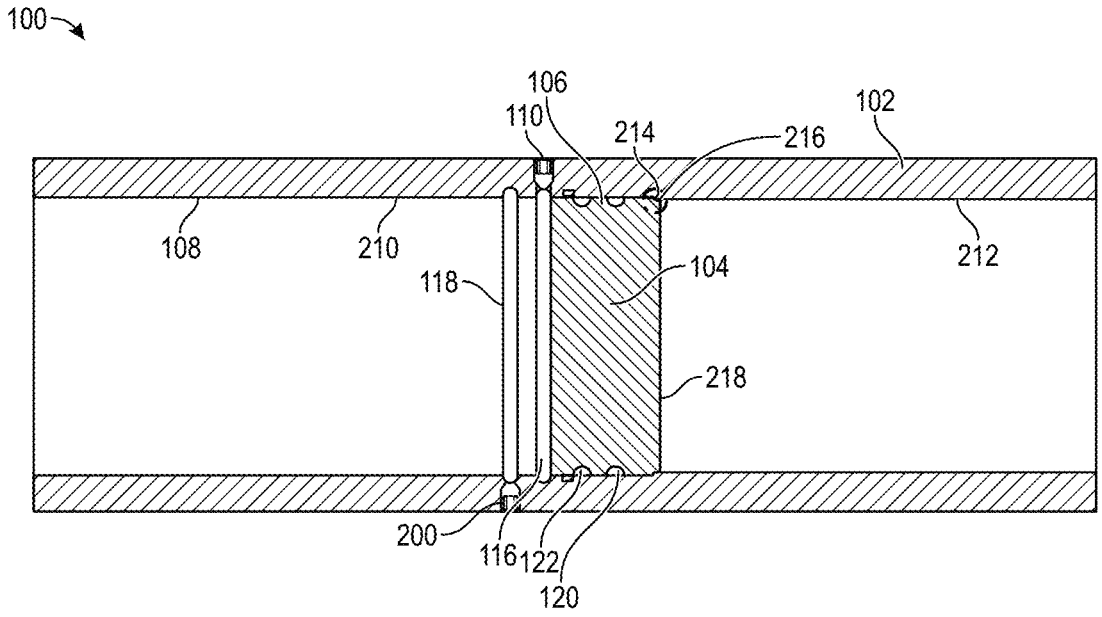
FIG. 3A illustrates a side, cross-sectional view of the downhole tool in a second configuration, according to an embodiment.
Figure 3B:
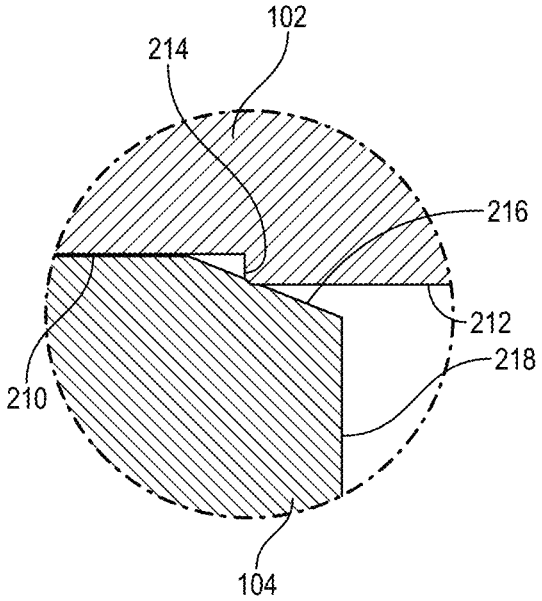
FIG. 3B illustrates an enlarged view of a portion FIG. 3A, according to an embodiment.

FIG. 3A illustrates a side, cross-sectional view of the downhole tool 100 in a second configuration, according to an embodiment. In this configuration, the retention members 114 have yielded, releasing the frangible obstruction 104 to move, e.g., in a downhole direction (to the right in this view) from the position thereof in the first configuration (FIG. 2). When this occurs, the frangible obstruction 104 may slide axially (e.g., toward the right, in the downhole direction) in the outer housing 102 responsive to a hydraulic force incident on the frangible obstruction 104. However, the frangible obstruction 104 may be too large to fit fully into the second section 212, and, as a consequence, the beveled nose 216 may press against an edge of the shoulder 214. FIG. 3B illustrates this engagement between the beveled nose 216 and the shoulder 214. The small surface area of the edge of the shoulder 214 may produce a high pressure on the frangible obstruction 104. Further, the frangible obstruction 104 may impact the shoulder 214, shock loading the frangible obstruction 104. Accordingly, the release of the frangible obstruction 104 by yielding the retention members 114 may cause the frangible obstruction 104 to break when it engages the shoulder 214.

Figure 4:
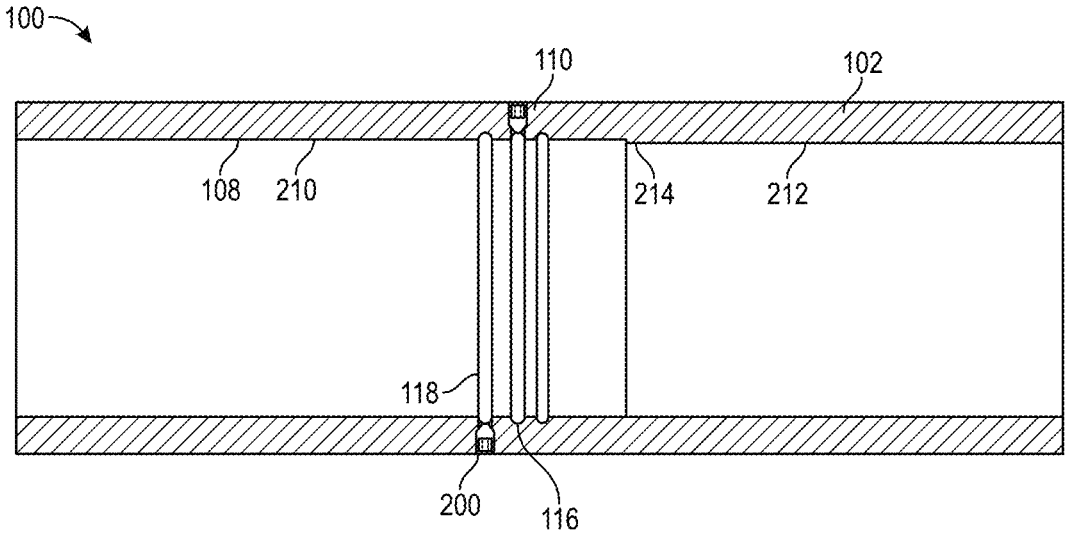
FIG. 4 illustrates a side, cross-sectional view of the downhole tool in a third configuration, according to an embodiment.

FIG. 4 illustrates a side, cross-sectional view of the downhole tool 100 in a third configuration, according to an embodiment. In this configuration, the frangible obstruction 104 (e.g., FIG. 3) has broken apart and fallen out of the downhole tool 100. The outer housing 102 remains and is substantially unobstructed, providing a full-bore access therethrough.

Figure 5:
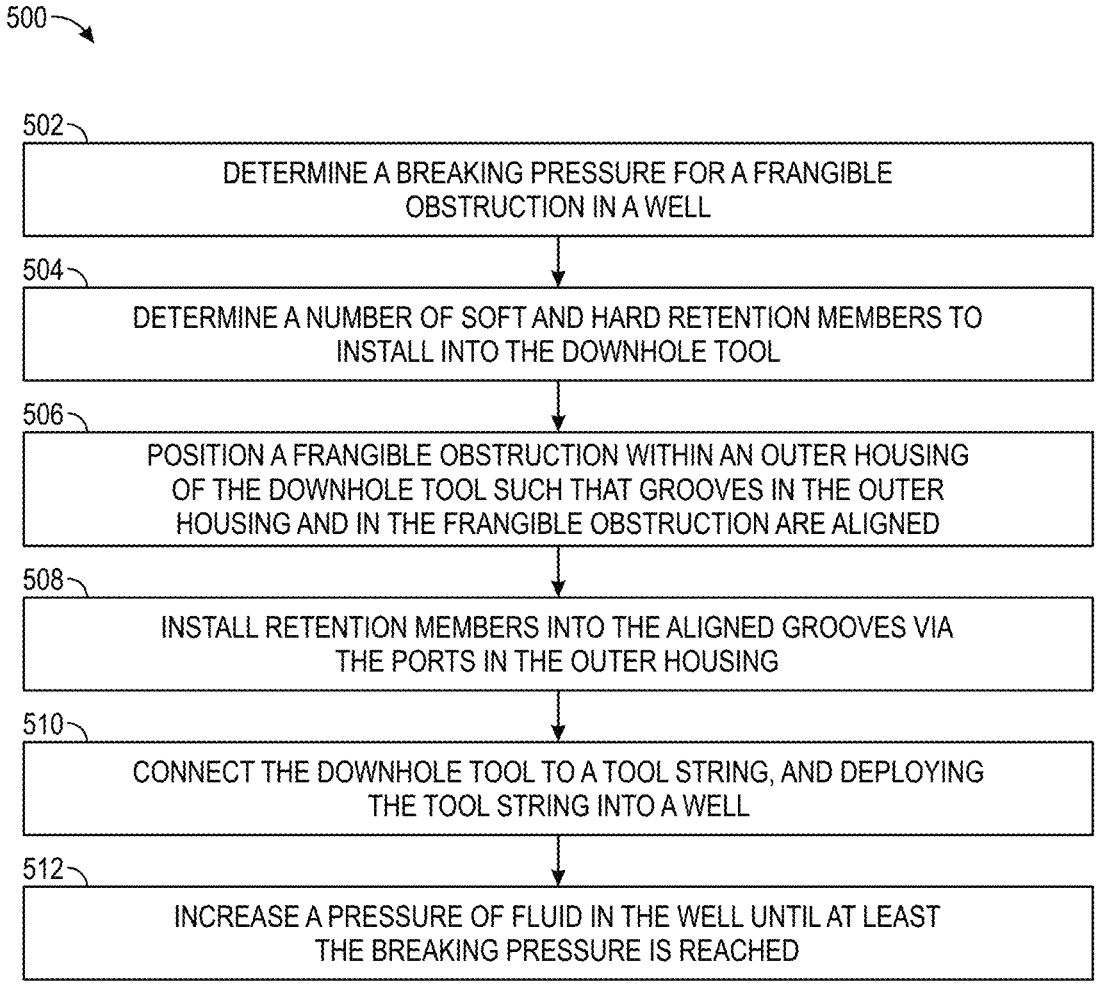
FIG. 5 illustrates a flowchart of a method for operating a downhole tool, according to an embodiment.

FIG. 5 illustrates a flowchart of a method 500 for operating a downhole tool, according to an embodiment. The method 500 may be executed using an embodiment of the downhole tool 100 discussed above, but is not limited to any particular structure unless otherwise indicated herein. Further, the steps of the method 500 may be executed in the order presented, or in any other order, combined, separated, conducted in parallel, etc.

With additional reference to FIG. 1, the method 500 may include determining a breaking pressure for a frangible obstruction 104 in a well, as at 502. This may be determined as a pressure that opens a tool string, permitting well fluid to enter or flow through the string. The method 500 may then include determining a number of soft and hard retention members 114 to install into the downhole tool 100, based on the determined breaking pressure, as at 504. For example, the soft retention members 114 may not contribute, or may contribute relatively less, to the yield strength of the tool 100, while the relatively hard retention member 114 may contribute relatively more to the yield strength thereof.

The method 500 may then include positioning a frangible obstruction 104 within an outer housing 102, such that first grooves 116, 118 and/or second grooves 120, 122 are aligned, as at 506. The method 500 may then include installing retention members 114 into the aligned pairs of grooves 116, 118 and 120, 122 via the ports 110, 200, as at 508. The retention members 114 may be selected as a number of relatively hard and a number of relatively soft retention members 114, based on the determination at 504. It will be appreciated that the relatively hard/soft members may not be represented by one two different types of retention members 114, but may be provided as several different types (e.g., made of different materials) that represent a spectrum between soft and hard.

The method 500 may then include connecting the downhole tool 100 into a tool string, and deploying the tool string into a well, as at 510. The method 500 may then include increasing a pressure of fluid in the well (e.g., using pumps) until the breaking force is generated by the fluid into the frangible obstruction 104, as at 512. This may cause the retention members 114 to yield, which releases the frangible obstruction 104 to move relative to the outer housing 102. The frangible obstruction 104 may then rapidly engage the shoulder 214 (FIGS. 3A and 3B), which breaks the frangible obstruction 104. The frangible obstruction 104 may then fall out of the outer housing 102 (FIG. 4), leaving a full-bore flowpath through the outer housing 102.

Figure 6:
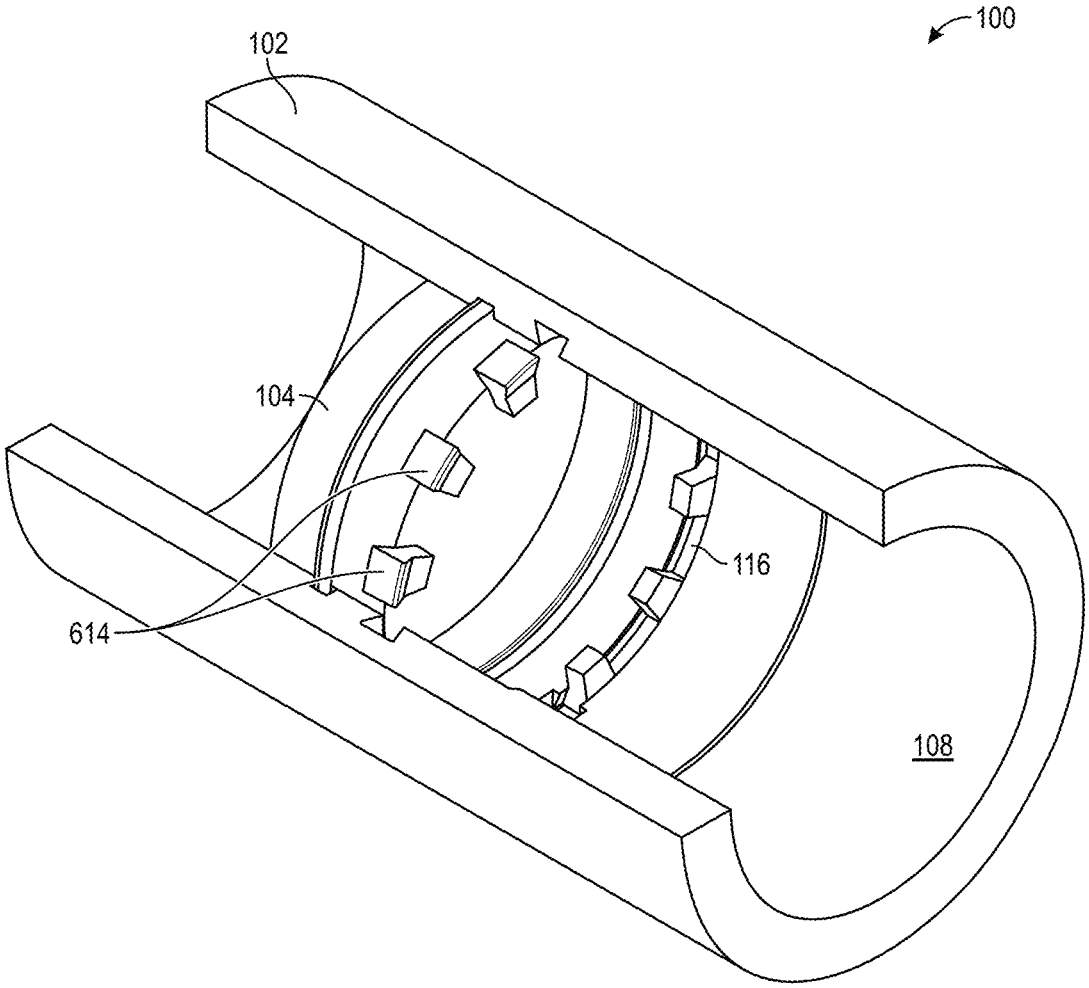
FIG. 6 illustrates a perspective, partially sectional view of the downhole tool with a body (e.g., frangible obstruction) and retention members (e.g., tabs) therein, according to an embodiment.

FIG. 6 illustrates a perspective, partially sectional view of the downhole tool 100 with the body (e.g., frangible obstruction) 104 and retention members (e.g., tabs) 614 therein, according to an embodiment. The downhole tool 100 may be substantially the same as shown in FIG. 1; however, in the embodiment of FIG. 6, the retention members 614 may be or include tabs instead of balls. As will be described in greater detail below, the retention members 614 may be positioned at least partially within the groove 116 in the inner diameter surface 108 of the outer housing 102. The retention members 614 may be circumferentially offset from one another.

At least some of the retention members 614 may be formed from a relatively hard material, such as a ceramic, metal, composite, etc. The retention members 614 may be configured to yield under a predetermined force, which may release the frangible obstruction 104 to move relative to the outer housing 102, as will be described in greater detail below. At least some of the retention members 614 may optionally be made from a sacrificial material that is relatively soft and yields at a lower force than the retention members 614 made of the harder material(s). For example, the softer retention members 614 may be made from a plastic. Thus, the softer retention members 614 may maintain a spacing of the retention members 614 relative to one another and/or a spacing/orientation of the frangible obstruction 104 relative to the outer housing 102, without substantially increasing the pressure at which the retention members 614 yield.

Thus, the force that results in the yielding of the retention members 614 and releasing of the frangible obstruction 104 may be configured by selecting a certain number of hard retention members 614 and a certain number of soft retention members 614. In some embodiments, additional tuning of the yielding force may be recognized by providing the relatively hard retention members 614 from two or materials with different hardness values. That is, one or more of the relatively hard retention members 614 may be made from a harder material that another one of the relatively hard retention members 614. Accordingly, a certain number of the different relatively hard retention members 614 may be selected to configure the tool 100.

Figure 7:
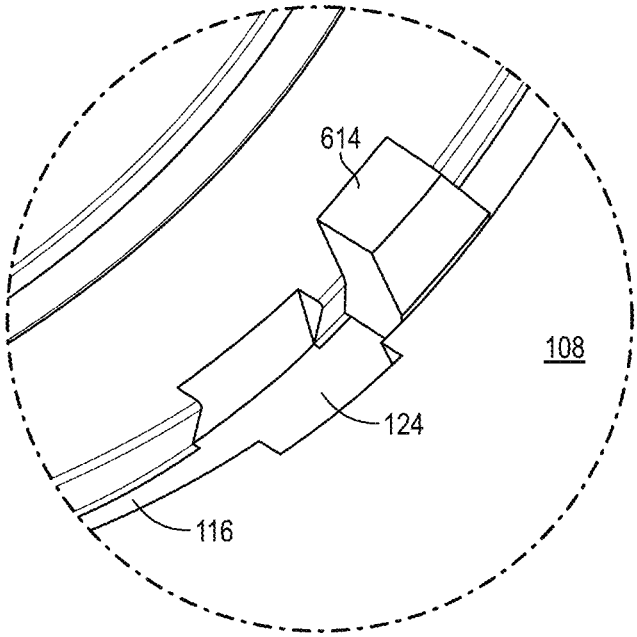
FIG. 7 illustrates a perspective view of a portion of an inner surface of the downhole tool showing a slot and a groove therein, according to an embodiment.

FIG. 7 illustrates a perspective view of a portion of the inner diameter surface 108 of the housing 102 showing the groove 116 and a slot 124 therein, according to an embodiment. The slot 124 may be or include a portion of the groove 116 with a greater width than a remainder of the groove 116. The retention members 614 may be introduced into (and/or removed from) the groove 116 via the slot 124. Once the retention members 614 are moved (e.g., circumferentially) within the groove 116 so that they are no longer aligned with the slot 124 (as shown in FIG. 7), they may be secured within the groove 116 and thus may not be removed (e.g., radially) therefrom. For example, the retention members 614 may be secured within the groove 116 via a dovetail connection.

Figure 8:
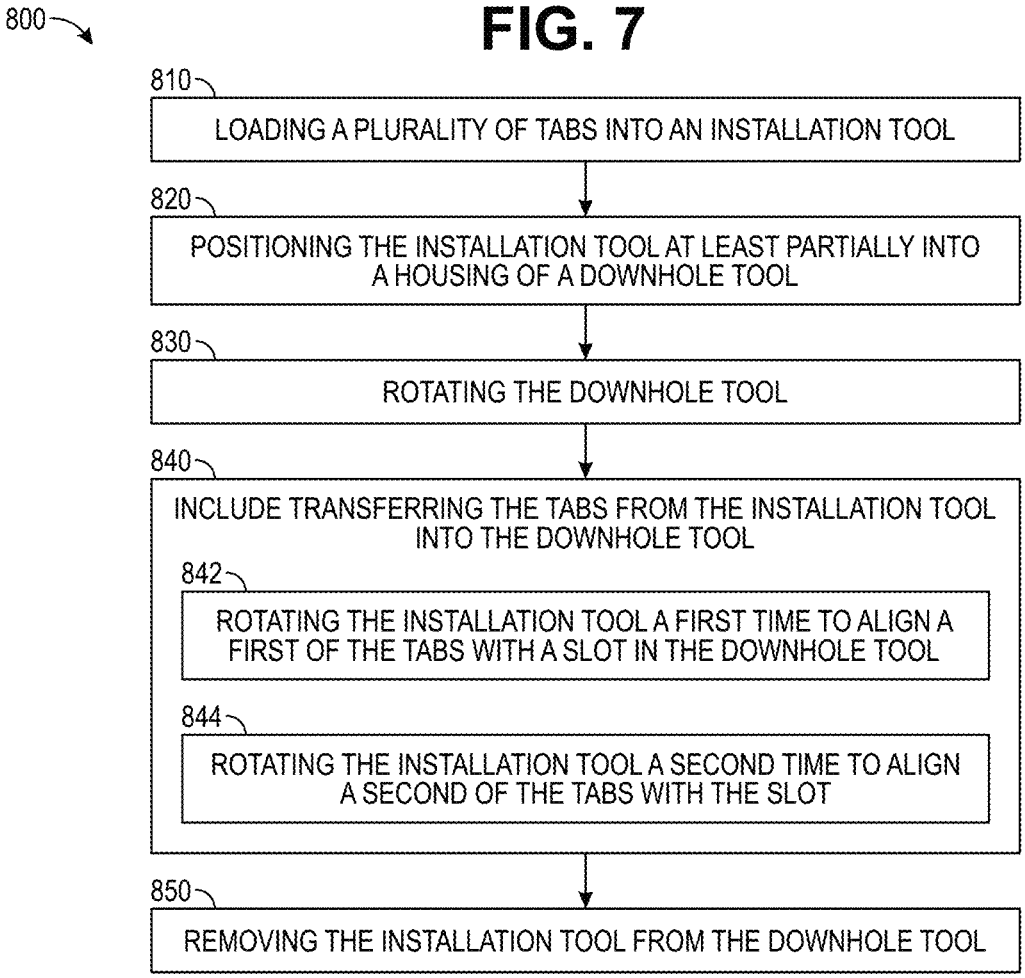
FIG. 8 illustrates a flowchart of a method for operating the downhole tool shown in FIG. 6.

FIG. 8 illustrates a flowchart of a method 800 for operating the downhole tool 100 shown in FIGS. 6 and 7, according to an embodiment. The method 800 is a modified version of step 508 in FIG. 5. More particularly, the method 800 may be for installing the retention members (e.g., tabs) 614 into the groove 116 in the inner diameter surface 108 of the housing 102 of the downhole tool 100. An illustrative order of the method 800 is provided below; however, one or more steps of the method 800 may be performed in a different order, simultaneously, repeated, or omitted.

Figure 9A:
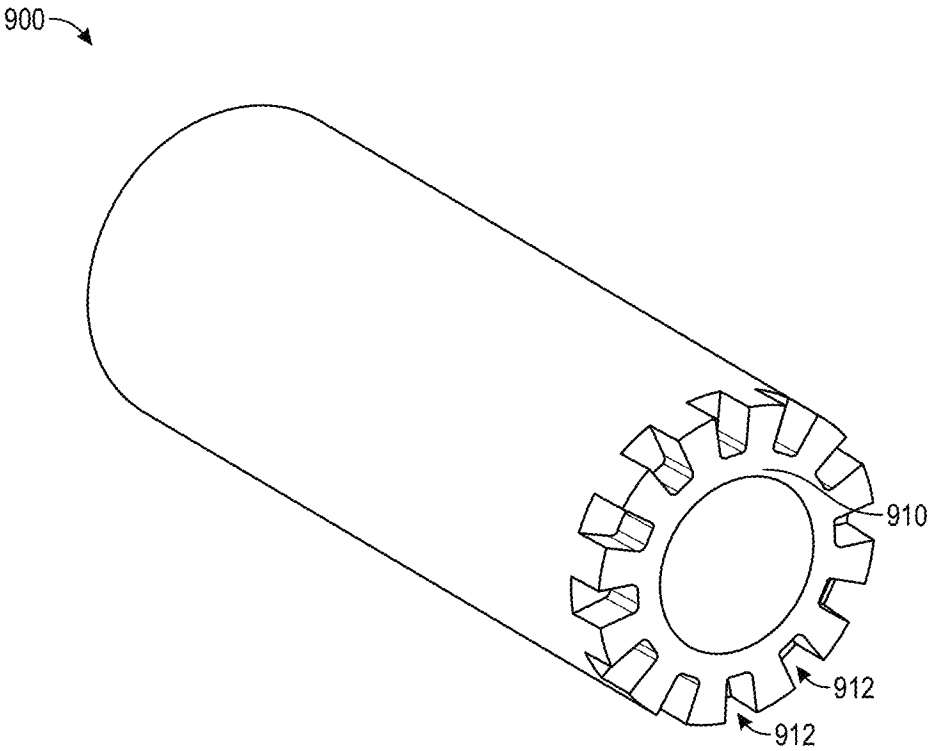
FIG. 9A illustrates a perspective view of an installation tool in an unloaded configuration.
Figure 9C:
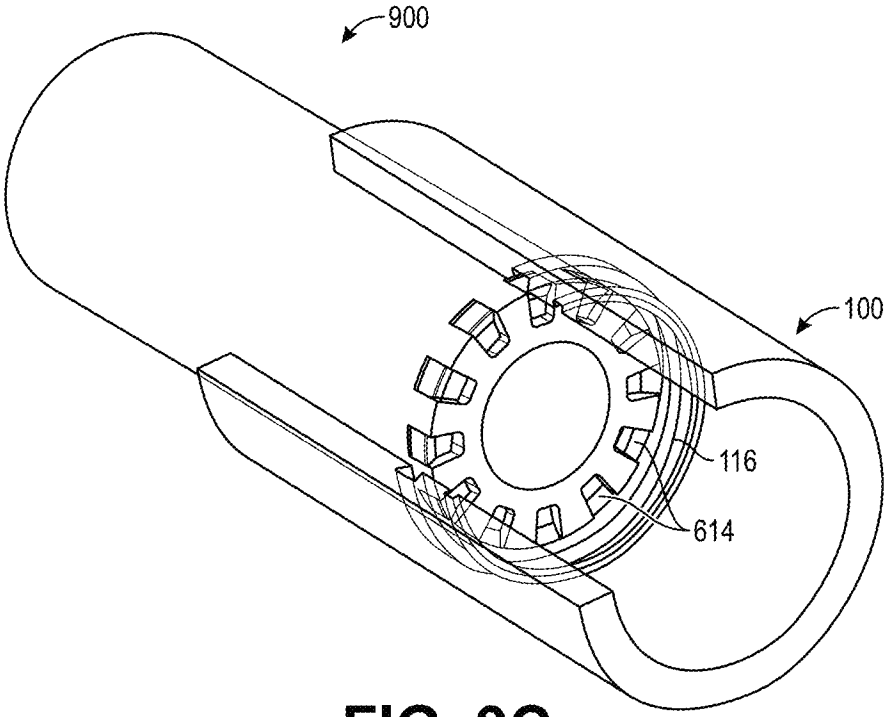
FIG. 9C illustrates the installation tool in the loaded configuration positioned at least partially within the downhole tool shown in FIG. 6, according to an embodiment.
Figure 9B:
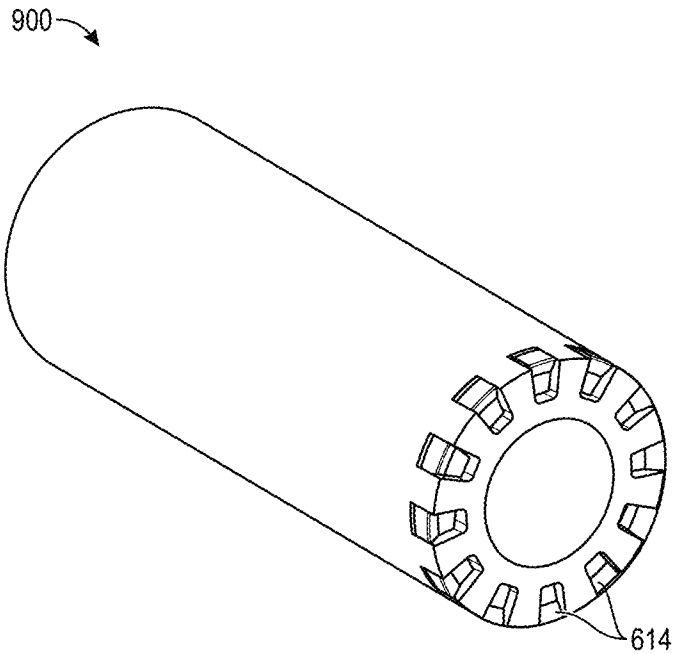
FIG. 9B illustrates a perspective view of the installation tool in a loaded configuration (e.g., with a plurality of tabs loaded therein)

The method 800 may include loading a plurality of retention members 614 into an installation tool, as at 810. FIG. 9A illustrates a perspective view of an installation tool 900 in an unloaded configuration (e.g., with no retention members 614 therein), according to an embodiment. An axial end 910 of the installation tool 900 may include or define a plurality of recesses 912 that are circumferentially offset from one another. The retention members 614 may be loaded into these recesses 912, as shown in FIG. 9B. The number of recesses 912 (and thus the retention members 614) may be selected based upon the desired predetermined force to release the frangible obstruction 104 to move relative to housing 102.

The method 800 may also include positioning the installation tool 900 at least partially into the housing 102 of the downhole tool 100, as at 820. More particularly, the axial end 910 may be introduced into the bore of the downhole tool 100 and moved (e.g., axially) toward the frangible obstruction 104 and/or the groove 116. This is shown in FIG. 9C. In one embodiment, the installation tool 900 may be moved until the axial end 910 abuts the frangible obstruction 104.

The method 800 may also include rotating the downhole tool 100, as at 830. The downhole tool 100 may be rotated before or after the installation tool 900 is positioned therein. The downhole tool 100 may be rotated such that the slot 124 becomes positioned at a bottom of the downhole tool 100 (e.g., six o'clock on a vertically-oriented clock). As described below, this may allow the retention members 614 to descend vertically through the slot 124 and into the groove 116 via gravity.

Figure 10A:
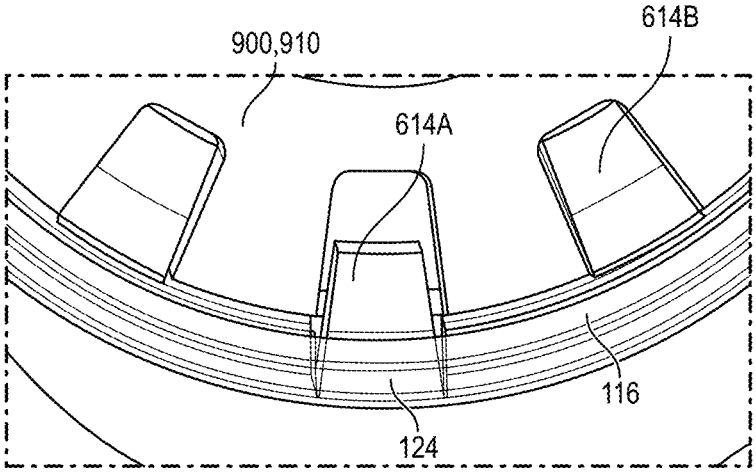
FIG. 10A illustrates the installation tool transferring a first of the retention members into the groove in the downhole tool.

The method 800 may also include transferring the retention members 614 from the installation tool 900 into the downhole tool 100, as at 840. This may include rotating the installation tool 900 a first time (e.g., from 1 degree to about 20 degrees) to align a first of the retention members 614A with the slot 124, as at 842. In another embodiment, the first retention member 614A may initially be aligned with the slot 124, and thus, the first rotation may be omitted. As mentioned above, the first retention member 614A may then fall out of its recess 912 in the installation tool 900, through the slot 124, and into the groove 116 of the downhole tool 100. This is shown in FIG. 10A.

Figure 10B:
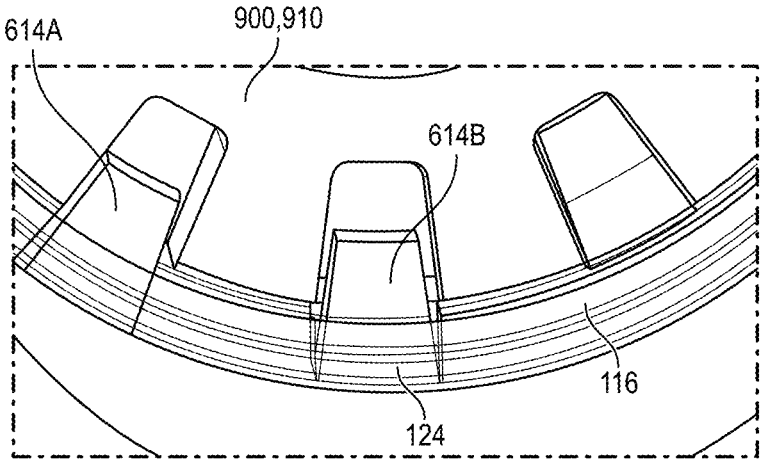
FIG. 10B illustrates the installation tool, after being rotated, transferring a second of the retention members into the groove in the downhole tool, according to an embodiment.

Introducing the retention members 614 may also include rotating the installation tool 900 a second time (e.g., from about 5 degrees to about 20 degrees) to align a second of the retention members 614B with the slot 124, as at 844. This is shown in FIG. 10B. Rotating the installation tool 900 the second time may accomplish two things. First, it may move/push the first retention member 614A (e.g., circumferentially) within the groove 116 so that the first retention member 614A is no longer aligned with the slot 124. As a result, the first retention member 614A may be secured within the groove 116 (e.g., via the dovetail connection) and may not be removed (e.g., radially) therefrom. Second, it may align the second retention member 614B with the slot 124 so that the second retention member 614B may fall out of its recess 912 in the installation tool 900, through the slot 124, and into the groove 116 of the downhole tool 100. This process may repeat until all of the retention members 614 are transferred from the installation tool 900 into the groove 116 of the downhole tool 100.

Figure 11A:
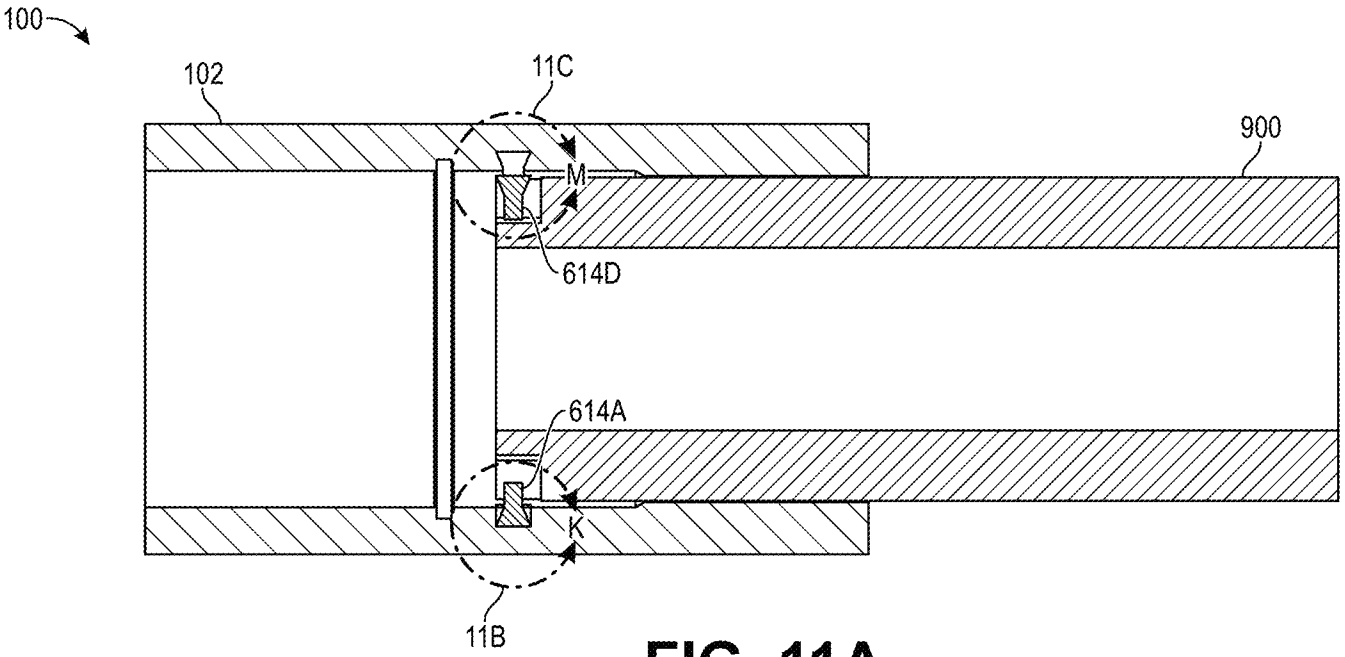
FIG. 11A illustrates a cross-sectional side view of the tabs being loaded through a slot in the downhole tool.
Figure 11C:
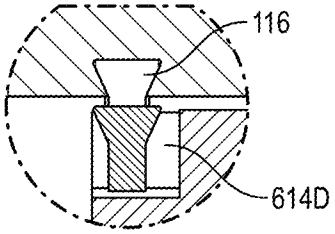
FIG. 11C illustrates an enlarged view of another portion of FIG. 11A, according to an embodiment.
Figure 11B:
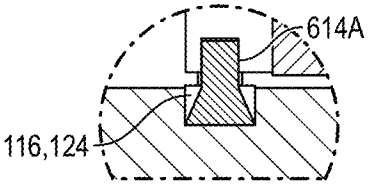
FIG. 11B illustrates an enlarged view of a portion of FIG. 11A.

FIG. 11A illustrates a cross-sectional side view of the first retention member 614A being loaded through the slot 124 and into the groove 116 in the downhole tool 100, according to an embodiment. FIG. 11B an enlarged portion of FIG. 11A showing the first retention member 614A being loaded through the slot 124 and into the groove 116 in the downhole tool 100. FIG. 11C shows another enlarged portion of FIG. 11A showing another retention member 614D still positioned within its recess 912 in the installation tool 900 (e.g., not yet within the groove 116 in the downhole tool 100). Each of the retention members 614A-614D may include an outer portion and an inner portion. The outer portion is configured to be positioned within the groove 116, and the inner portion is configured to contact the frangible obstruction 104 and to prevent the frangible obstruction 104 from moving in the downhole direction.

The method 800 may also include removing the installation tool 900 from the downhole tool 100, as at 850. This may be performed once all of the retention members 614 are transferred from the installation tool 900 into the groove 116 of the downhole tool 100.

Figure 12A:
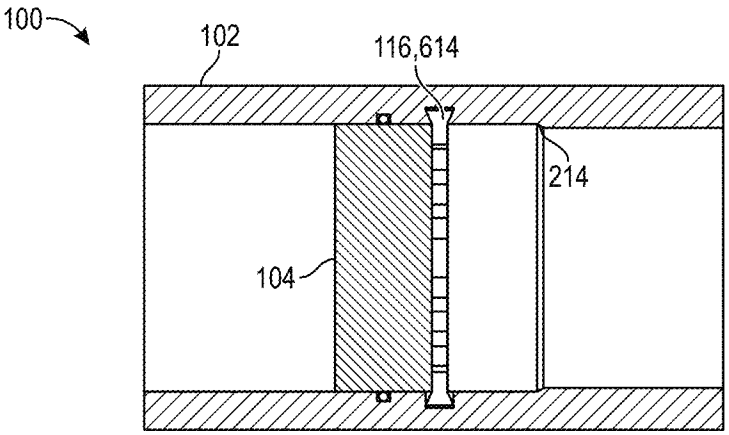
FIG. 12A illustrates a side, cross-sectional view of the downhole tool in a first configuration.

Once the method 800 (e.g., the modified version of step 508 in FIG. 5) is complete, the downhole tool 100 may be connected to a tool string and deployed into the well (e.g., step 510 in FIG. 5). The downhole tool 100 may be connected and deployed in a first (e.g., run-in-hole) configuration. This is shown in FIG. 12A. In the first configuration, the frangible obstruction 104 may be prevented from moving in a downhole direction relative to the housing 102 by the retention members 614.

Figure 12B:
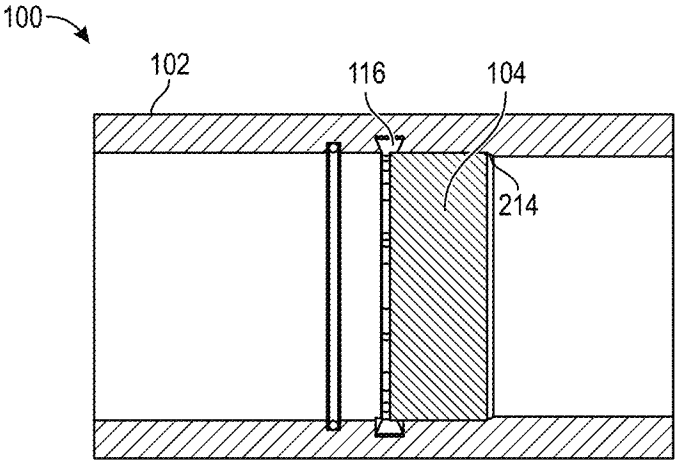
FIG. 12B illustrates a side, cross-sectional view of the downhole tool in a second configuration.
Figure 12C:
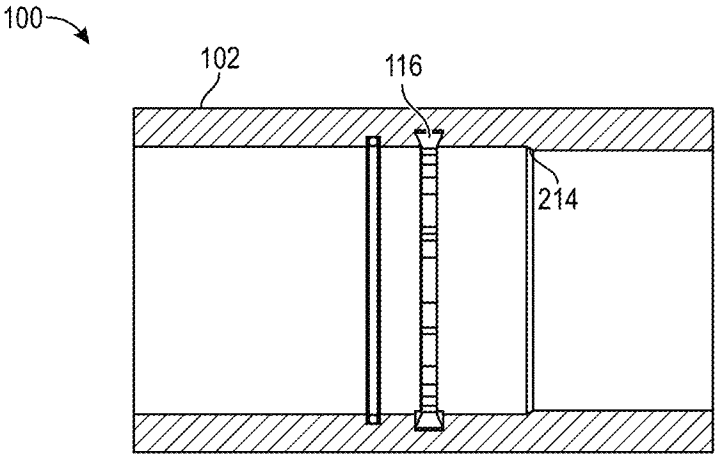
FIG. 12C illustrates a side, cross-sectional view of the downhole tool in a third configuration, according to an embodiment.

The pressure of the fluid in the well may then be increased until the breaking pressure is reached (e.g., step 512 in FIG. 5). This may cause the (e.g., inner portions of the) retention members 614 to yield, which releases the frangible obstruction 104 to move relative to the outer housing 102 (e.g., in the downhole direction toward the shoulder 214). This is shown in FIG. 12B. The frangible obstruction 104 may then rapidly engage the shoulder 214 on the inner diameter surface 108 of the downhole tool 100, which breaks the frangible obstruction 104. This is shown in FIG. 12C. The frangible obstruction 104 may then fall out of the housing 102, leaving a full-bore flowpath through the housing 102.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a housing having an inner surface, wherein an inner groove is formed in the inner surface;

a body positioned in the housing;

a plurality of retention members positioned at least partially within the inner groove, wherein the retention members initially prevent the body from moving in a downhole direction relative to the housing, and wherein the retention members are configured to yield, which allows the body to move in the downhole direction relative to the housing; and an installation tool configured to have the plurality of retention members loaded therein and configured to transfer the retention members into the inner groove from within the housing.

2. The downhole tool of claim 1, wherein the retention members are circumferentially offset from one another in the inner groove.

3. The downhole tool of claim 1, wherein the retention members comprise tabs, wherein each tab has an outer portion and an inner portion, wherein the outer portion is positioned within the inner groove, and wherein the inner portion is configured to contact the body.

4. The downhole tool of claim 3, wherein the outer portion forms a dovetail connection with the inner groove, and wherein the inner portion is configured to yield in response to a predetermined force exerted thereon by the body.

5. The downhole tool of claim 1, wherein the inner groove includes a slot that has a greater width than a remainder of the inner groove, and wherein the retention members are configured to be introduced radially-outward through the slot and into the inner groove.

6. The downhole tool of claim 5, wherein the retention members are configured to slide circumferentially within the inner groove after being introduced via the slot, and wherein the retention members are prevented from being removed from the inner groove when the retention members are misaligned with the slot.

7. The downhole tool of claim 1, wherein the housing defines a shoulder therein, and wherein the body is configured to impact the shoulder and break apart after the retention members yield.

8. The downhole tool of claim 7, wherein the body defines a beveled nose that is configured to fit at least partially through the shoulder prior to the body breaking apart.

9. A casing float sub for use in a well, the casing float sub comprising:

a housing having an inner surface, wherein a groove and a shoulder are formed in the inner surface, and wherein the groove includes a slot that has a greater width than a remainder of the groove;

a body positioned in the housing, wherein the body defines a beveled nose that is configured to fit at least partially through the shoulder; and a plurality of tabs positioned at least partially within the groove, wherein the tabs are configured to be introduced radially-outward through the slot and into the groove by an installation tool that is configured to have the plurality of tabs loaded therein and configured to be positioned within the housing, wherein the tabs are configured to slide circumferentially within the groove after being introduced via the slot such that the tabs become circumferentially offset from one another within the groove, wherein the tabs are prevented from being removed from the groove when the tabs are misaligned with the slot, wherein each tab has an outer portion and an inner portion, wherein the outer portions form dovetail connections within the groove, wherein the inner portions are configured to contact the body, wherein the inner portions initially prevent the body from moving in a downhole direction relative to the housing, wherein the inner portions are configured to yield in response to a predetermined force exerted therein by the body, which allows the body to move in the downhole direction relative to the housing, and wherein the body is configured to impact the shoulder and break apart after the inner portions yield.

10. A method, comprising:

positioning a body in a housing, wherein the housing has an inner surface, and wherein a groove is formed in the inner surface;

positioning a plurality of retention members at least partially within the groove, wherein positioning the retention members comprises:

loading the retention members into an installation tool;

positioning the installation tool, with the retention members loaded therein, into the housing; and transferring the retention members from the installation tool to the groove in the inner surface of the housing, wherein the retention members initially prevent the body from moving in a downhole direction relative to the housing;

deploying the body, the housing, and the retention members into a well; and increasing a pressure of a fluid in the well, which causes the retention members to yield, and wherein the body moves relative to the housing in response to the increased pressure and the retention members yielding.

11. The method of claim 10, wherein the retention members are loaded into recesses formed in an axial end of the installation tool, and wherein the recesses are circumferentially offset from one another.

12. The method of claim 11, wherein positioning the retention members further comprises abutting the axial end of the installation tool with the body while the retention members are transferred.

13. The method of claim 10, wherein the groove includes a slot that has a greater width than a remainder of the groove, and wherein positioning the retention members further comprises rotating the housing until the slot is positioned at a bottom of the housing such that the retention members are transferred radially-outward, via gravity, through the slot and into the groove.

14. The method of claim 10, wherein the groove includes a slot that has a greater width than a remainder of the groove, and wherein positioning the retention members further comprises:

rotating the installation tool a first time relative to the housing, which causes a first of the retention members to be transferred from the installation tool, through the slot, and into the groove; and rotating the installation tool a second time relative to the housing, which pushes the first retention member out of alignment with the slot, wherein the first retention member is prevented from being removed from the groove when the first retention member is out of alignment with the slot, and wherein rotating the installation tool a second time also causes a second of the retention members to be transferred from the installation tool, through the slot, and into the groove, such that the first and second retention members are circumferentially offset from one another in the groove.

15. The method of claim 10, further comprising:

determining the pressure that causes the retention members to yield; and selecting a number of relatively hard retention members and a number of relatively soft retention members based on the pressure that causes the retention members to yield, wherein the retention members that are positioned within the groove comprise the number of relatively hard retention members and the number of relatively soft retention members.

16. The method of claim 10, wherein the body comprises a frangible obstruction member, and wherein the body moving in the housing comprises the frangible obstruction member impacting a shoulder in the housing and breaking.

* * * * *